US005893965A

United States Patent [19]

Trokhan et al.

[11] Patent Number: 5,893,965

[45] Date of Patent: Apr. 13, 1999

[54] METHOD OF MAKING PAPER WEB USING FLEXIBLE SHEET OF MATERIAL

[75] Inventors: Paul Dennis Trokhan, Hamilton; Vladimir Vitenberg, Cincinnati, both of Ohio

[73] Assignee: The Procter & Gamble Company, Cincinnati, Ohio

[21] Appl. No.: 08/870,544

[22] Filed: Jun. 6, 1997

[51] Int. Cl.[6] ..... D21F 11/00

[52] U.S. Cl. ..... 162/205; 162/111; 162/115; 162/116

[58] Field of Search ..... 162/111, 116, 162/117, 204, 115, 205, 358.1, 358.2, 358.3, 358.4, 360.2, 361; 264/282, 283

[56] References Cited

U.S. PATENT DOCUMENTS

| | | | |
|---|---|---|---|
| 2,862,251 | 12/1958 | Kalwaites . | |
| 3,537,954 | 11/1970 | Justus | 162/305 |
| 4,144,124 | 3/1979 | Turunen et al. | 162/290 |
| 4,309,246 | 1/1982 | Hulit et al. | 162/113 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,637,859 | 1/1987 | Trokhan | 162/109 |
| 5,334,289 | 8/1994 | Trokhan et al. | 162/358.2 |
| 5,505,818 | 4/1996 | Hermans et al. | 162/113 |
| 5,629,052 | 5/1997 | Trokhan et al. | 427/508 |
| 5,637,194 | 6/1997 | Ampulski et al. | 162/109 |
| 5,830,316 | 11/1998 | Ampulski | 162/117 |

FOREIGN PATENT DOCUMENTS

| | | |
|---|---|---|
| WO 95/17548 | 6/1995 | WIPO . |
| WO 96/00813 | 1/1996 | WIPO . |
| WO 96/00814 | 1/1996 | WIPO . |

*Primary Examiner*—Stanley S. Silverman
*Assistant Examiner*—José A. Fortuna
*Attorney, Agent, or Firm*—Vladimir Vitenberg; Larry L. Huston; E. Kelly Linman

[57] ABSTRACT

A process for making a paper sheet is disclosed. After a web is transferred from a forming wire to a papermaking belt preferably having deflection conduits, the web is overlaid with a flexible sheet of material such that the web is disposed intermediate the sheet of material and the papermaking belt. The sheet of material has an air permeability less than the papermaking belt, and is preferably air-impermeable. An application of a fluid pressure differential to the sheet of material causes deflection of at least a portion of the sheet of material towards the papermaking belt and, preferably, deflection of at least a portion of the web into the conduits of the papermaking belt and water removal from the web through the conduits of the papermaking belt.

20 Claims, 3 Drawing Sheets

METHOD OF MAKING PAPER WEB USING FLEXIBLE SHEET OF MATERIAL

FIELD OF THE INVENTION

The present invention is related to processes for making strong, soft, absorbent paper webs. More particularly, this invention is concerned with the papermaking process in which a paper web is disposed intermediate a papermaking belt and a flexible sheet of material.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products. If the paper products such as paper towels, facial tissues, toilet tissues, and the like are to perform their intended tasks and to find wide acceptance, they must possess certain physical characteristics. Among the more important of these characteristics are strength, softness, and absorbency.

Strength is the ability of a paper web to retain its physical integrity during use.

Softness is the pleasing tactile sensation consumers perceive when they use the paper for its intended purposes.

Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid.

U.S. Pat. No. 3,537,954 issued to Justus discloses a web formed between an upper fabric and a lower forming wire. A pattern is imparted to the web at a nip where the web is sandwiched between the fabric and a relatively soft and resilient papermaking felt. U.S. Pat. No. 4,309,246 issued to Hulit et al. discloses delivering an uncompacted wet web to an open mesh imprinting fabric formed of woven elements, and pressing the web between a papermaker's felt and the imprinting fabric in a first press nip. The web is then carried by the imprinting fabric from the first press nip to a second press nip at a drying drum. U.S. Pat. No. 4,144,124 issued to Turunen et al. discloses a paper machine having a twin-wire former having a pair of endless fabrics, which can be felts. One of the endless fabrics carries a paper web to a press section. The press section can include the endless fabric which carries the paper web to the press section, an additional endless fabric which can be a felt, and a wire for patterning the web.

PCT Publication WO95/17548 having a U.S. priority date of Dec. 20, 1993 and published Jun. 29, 1995 in the name of Ampulski et al.; and PCT Publication WO96/00813 having a U.S. priority date of Jun. 29, 1994 and published Jan. 11, 1996 in the name of Trokhan et al. disclose papermaking methods employing dewatering felt layers.

While suitable methods of making paper webs are disclosed in the art, paper scientists continue to search for even better methods of making patterned paper structures economically and with increased strength, without sacrificing softness and absorbency.

Through-air dried paper webs are made as described in U.S. Pat. No. 4,514,345 issued to Johnson et al on Apr. 30, 1985; U.S. Pat. No. 4,528,239 issued to Trokhan on Jul. 9, 1985; and U.S. Pat. No. 5,334,289 issued to Trokhan et al on Aug. 2, 1994, all three patents are assigned to The Procter and Gamble Company and incorporated herein by reference.

Paper produced by through air drying is disclosed in U.S. Pat. No. 4,529,480 and U.S. Pat. No. 4,637,859, both issued in the name of Trokhan, which patents are incorporated herein by reference. The paper of these patents is characterized by having two physically distinct regions: a continuous network region having a relatively high density and a region comprised of a plurality of domes dispersed throughout the whole of the network region. The domes are of relatively low density and relatively low intrinsic strength compared to the network region.

Generally, through-air drying papermaking processes include several steps. An aqueous dispersion of the papermaking fibers is formed into an embryonic web on a foraminous member, such as a Fourdrinier wire. This embryonic web is associated with a deflection member having a macroscopically monoplanar, continuous, patterned non-random network surface which defines within the deflection member a plurality of discrete, isolated deflection conduits. The papermaking fibers in the embryonic web are deflected into the deflection conduits and water is removed through the deflection conduits to form an intermediate web. The intermediate web may optionally be dried and foreshortened by creping. Creping is a process of the removal of the dried intermediate web from the surface (usually, also drying surface, such as the surface of a Yankee dryer) with a doctor blade to form a finished paper web.

Deflection of the fibers into the deflection conduits can be induced by, for example, the application of differential fluid pressure to the embryonic paper web. One preferred method of applying differential pressure is by exposing the embryonic web to a vacuum through the deflection conduits. As a result of a sudden application of the vacuum pressure, a deflection of the fibers into the deflection conduits occurs, which can lead to separation of the deflected fibers from each other and from the embryonic web. In addition, as a result of a sudden application of a vacuum pressure, a certain number of partially dewatered fibers separated from the embryonic web could completely pass through the papermaking belt. These phenomena cause formation of pin-sized holes, or pinholes, in the domes of the finished paper web and clogging the vacuum dewatering machinery.

The undesirable creation of pinholes in the domes of the paper web, or pinholing, was mitigated by commonly assigned U.S. Pat. No. 5,334,289, issued on Aug. 2, 1994 to Trokhan et al. and incorporated by reference herein. This patent provided surface texture irregularities in the backside network. The backside irregularities mitigate the effect of a sudden application of a vacuum pressure. Still, the search for improved products has continued.

Accordingly, it is an object of the present invention to provide a papermaking process which substantially reduces the pinholing in the finished paper web and the buildup of paper fibers on the vacuum dewatering machinery.

It is another object of the present invention to provide a papermaking process which allows to produce a paper sheet that has a more uniform basis weight distribution and a more uniform density distribution, relative to the papers produced by the through-air drying processes of the prior art.

It is further object of the present invention to provide a novel method for dewatering and molding a paper web.

It is still another object of the present invention to provide a method of enhancing water removal from a web during pressing of the web.

SUMMARY OF THE INVENTION

A process for making a paper sheet of the present invention comprises the steps of:

(a) providing an aqueous dispersion of papermaking fibers;

(b) forming a web of the papermaking fibers from the aqueous dispersion on a forming wire;

(c) transferring the web from the forming wire to a papermaking belt having a web-contacting side and a backside opposite the web-contacting side, the papermaking belt having a belt air permeability;

(d) providing a flexible sheet of material having a first side and a second side opposite the first side, the sheet of material having a sheet air permeability less than the belt air permeability;

(e) overlaying the web with the sheet of material such that the web is disposed intermediate the first side of the sheet of material and the web-contacting side of the papermaking belt;

(f) applying a fluid pressure differential to the sheet of material such that a pressure associated with the second side of the sheet of material is greater than a pressure associated with the first side of the sheet of material, thereby deflecting at least a portion of the sheet of material towards the papermaking belt;

(g) removing the sheet of material from over the web; and (h) drying the web to form the paper sheet.

The papermaking belt is preferably comprised of a framework and a reinforcing structure joined to the framework. The framework has a web-facing surface, a machine-facing surface, and a plurality of deflection conduits extending intermediate the web-facing surface and the machine-facing surface. The web-facing surface defines the web-contacting side of the papermaking belt, and the machine-facing surface defines the backside of the papermaking belt. The reinforcing structure is positioned between the web-facing surface and the machine-facing surface of the framework. The reinforcing structure has a first side and a second side opposite and parallel to the first side. The first side corresponds to and is parallel to the to web-facing surface, and the second side corresponds to and is parallel to the machine-facing surface of the framework. A distance between the web-facing surface of the framework and the first side of the reinforcing structure is an overburden. The web-facing surface comprises a web-side network formed therein and defining web-side openings of the conduits of the papermaking belt. The machine-facing surface comprises a machine-side network formed therein and defining machine-side openings of the conduits of the papermaking belt. Preferably, the reinforcing structure has the air permeability of greater than 1000 cfm per square foot at a pressure differential of 100 Pascals.

Preferably, the flexible sheet of material has a low air permeability of less than 5 scfm at a pressure differential of 0.5 inches of water, and more preferably, the flexible sheet of material is air-impermeable. When the fluid pressure differential is applied to the sheet of material, deflection of at least a portion of the sheet of material causes deflection of at least a portion of the papermaking fibers in the web into the deflection conduits of the papermaking belt and removal of water from the web through the conduits.

Portions of the sheet of material optionally may or may not deflect into the deflection conduits of the papermaking belt. If the sheet of material deflects into the deflection conduits, preferably, a maximal deflection of the sheet of material is greater than 25% of the papermaking belt's overburden in a Z-direction.

Optionally, the process of the present invention may include an additional step of pre-drying the web—prior or subsequent to the step (g), and/or an additional step of impressing the web-side network into the web by interposing the web between the papermaking belt and a rigid surface such, for example, as a Yankee drying drum. Also, the process may include an optional step of foreshortening the web, such as occurs by creping.

DETAILED DESCRIPTION OF THE INVENTION

Figure 1:
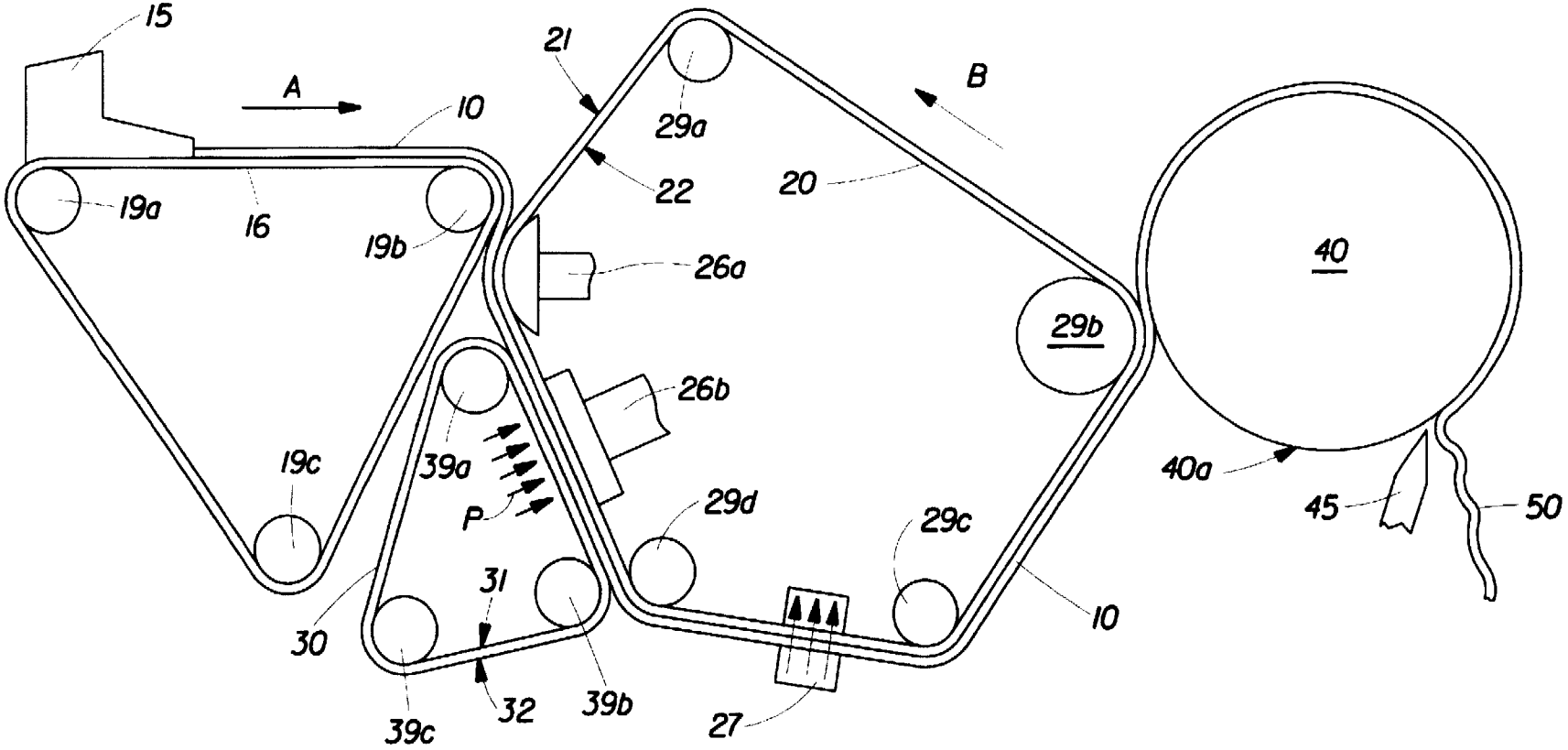
FIG. 1 is a schematic side elevational view of one embodiment of a continuous papermaking process of the present invention.

A representative papermaking machine suitable for the process of the present invention is schematically illustrated in FIG. 1. An aqueous dispersion of papermaking fibers, or slurry, is prepared in an equipment not shown and is deposited into a headbox 15 which can be of any conventional design. From the headbox 15, the aqueous dispersion of papermaking fibers is delivered to a forming wire 16, which is typically a foraminous member, also known as a Fourdrinier wire. In FIG. 1, the forming wire 16 is schematically shown as supported by a breast roll **19*a* and a plurality of return rolls, of which only two—19*b* and 19*c*—are illustrated. The forming wire 16** is propelled in the direction indicated by a directional arrow A by a drive means well known to one skilled in the art and therefore not shown.

The purpose of the headbox 15, the forming wire 16, the return rolls **19*a*, 19*b*, 19*c*, and the various auxiliary units and devices (not shown) associated with the headbox 15 and the forming wire 16 is to form an "embryonic" web of papermaking fibers. For clarity, as used herein, the web 10, regardless of the stages of its processing, is referenced by the same numeral "10," i. e., "embryonic" web 10, "intermediate" web 10, "predried" web 10, and so on. The finished product—a paper web—is referenced by the numeral "50" (FIG. 1**).

The embryonic web 10 is formed by removal of a portion of an aqueous dispersing medium using techniques well known in the art. Processes for forming embryonic webs are described in many references, such, for example, as U.S. Pat. No. 3,301,764 issued to Sanford and Sisson on Jan. 31, 1974, and U.S. Pat. No. 3,994,771 issued to Morgan and Rich on Nov. 30, 1976, both patents incorporated by reference herein.

After the embryonic web 10 is formed on the forming wire 16, the web is transferred from the forming wire 16 to a papermaking belt 20 having a belt air permeability Ab. Conventional equipment, such as vacuum pick-up shoe **26*a* (FIG. 1), may be utilized to accomplish the transferal. One skilled in the art will understand that the vacuum pick-up shoe 26*a* schematically shown in FIG. 1 is the one preferred means of transferring the web 10 from the forming wire 16** to the papermaking belt 20. Other equipment, such as intermediate belt or the like (not shown) may be utilized for the purpose of transferring the web 10 from the forming belt 16 to the papermaking belt 20. The commonly assigned U.S. Pat. No. 4,440,597 issued Apr. 3, 1984 to Wells is incorporated by reference herein. The preferred embodiment of the papermaking belt 20 utilized in the process of the present invention is a macroscopically monoplanar, fluid-permeable, endless belt supported by a plurality of rolls, four of which—29*a*, 29*b*, 29*c*, 29*d*—are schematically illustrated in FIG. 1. The papermaking belt 20 travels in the direction indicated by a directional arrow "B," as illustrated in FIG. 1. However, the papermaking belt 20 of the present invention may be incorporated into numerous other forms that include, for example, stationary plates for use in making handsheets, or rotating drums for use with other types of continuous process. Regardless of the physical form of the papermaking belt 20, it generally has certain characteristics.

Figure 2:
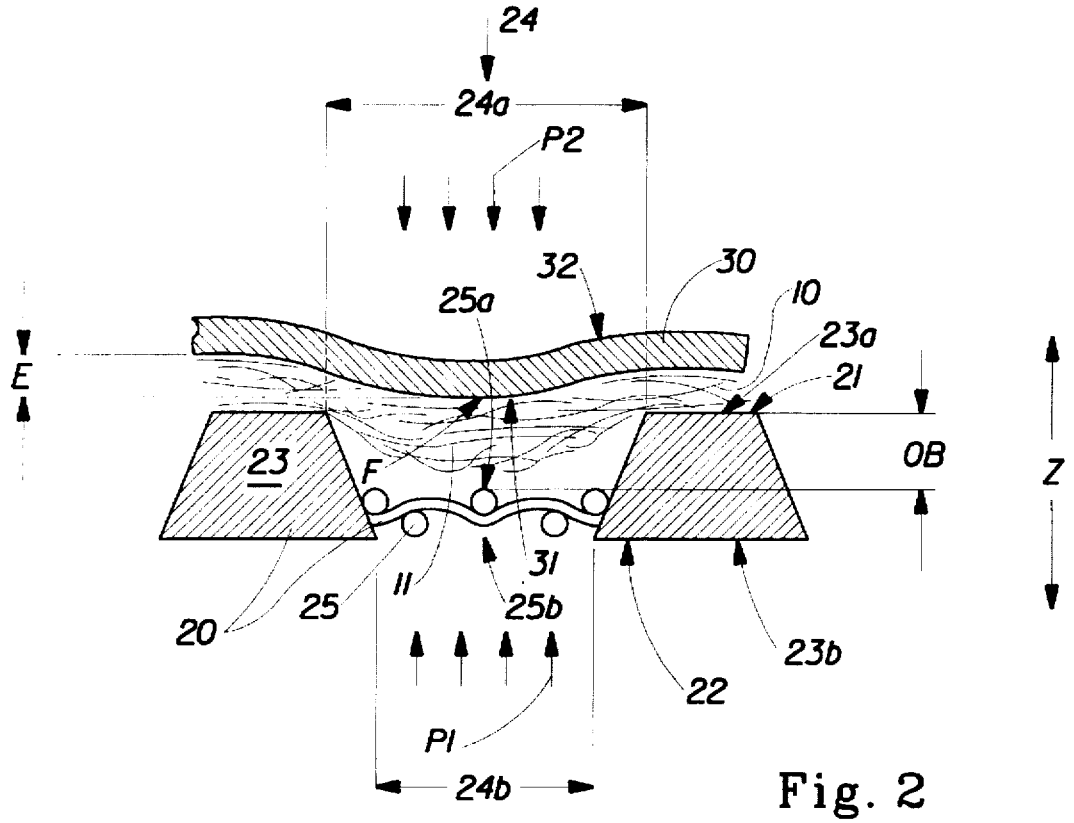
FIG. 2 is a schematic fragmental representation of a vertical cross-section showing the web overlaid with a flexible sheet of material, and the web's fibers being deflected into a conduit of the papermaking belt.
Figure 3:
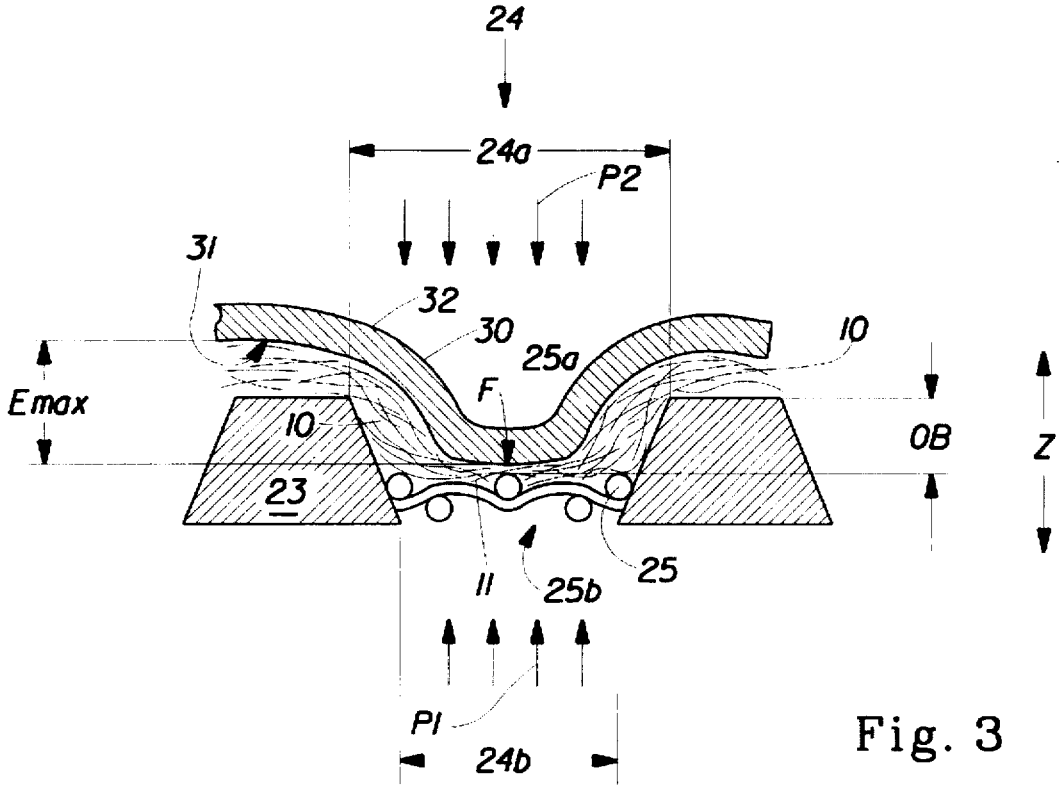
FIG. 3 is a schematic fragmental representation of a vertical cross-section similar to that shown in FIG. 2 and also showing the flexible sheet of material deflected into the conduit of the papermaking belt.

As shown in FIGS. 1–3, the papermaking belt, or simply "belt," 20 has a web-contacting side 21 and a backside 22 opposite the web-contacting side 21. As should be clear from the definition, the web-contacting side 21 contacts and thereby supports the web 10 on the belt 20. The backside 22 contacts the machinery employed in the papermaking process, such as a vacuum pick-up shoe 26*a* and a multislot vacuum box 26*b*.

The papermaking belt 20 is air-permeable and fluid-pervious in at least one direction, particularly the direction from the web-contacting side 21 to the backside 22. As used herein, the term "fluid-pervious" refers to the condition where a fluid (including air) carrier of a fibrous slurry may be transmitted through the belt 20 without significant obstruction. However, it is not necessary, or even desired, that the entire surface area of the belt 20 be fluid-pervious. It is only necessary that the liquid carrier of the fibrous slurry be easily removed from the slurry leaving on the web-contacting side 21 of the belt 20 an embryonic web 10 of the papermaking fibers.

Figure 4:
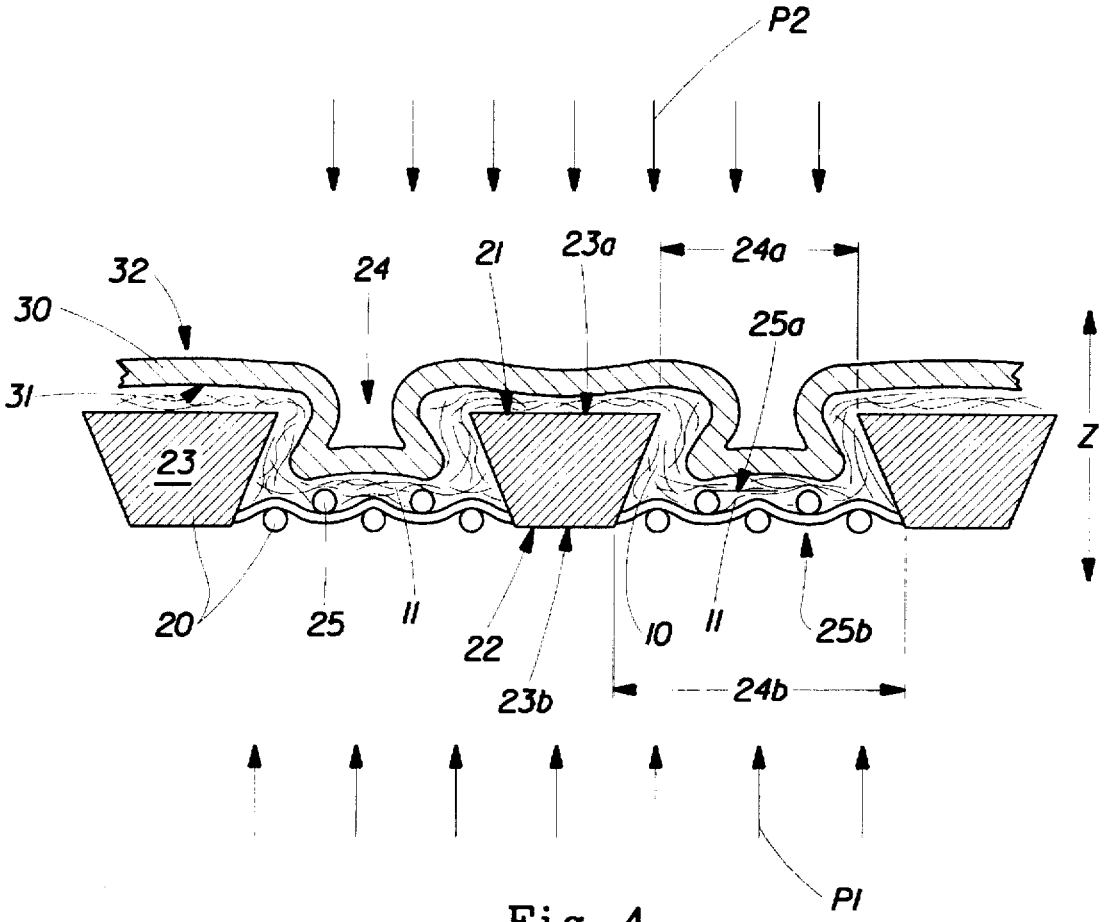
FIG. 4 is a schematic fragmental representation of a vertical cross-section similar to those shown in FIGS. 2 and 3, and showing formation of "mushroom" domes.

FIGS. 2, 3, and 4 show cross-sectional fragments of the preferred belt 20. As used herein, the general plane of the belt 20 forms an X-Y plane, and a Z-direction is a direction perpendicular to the X-Y plane. The belt 20 shown in FIGS. 2 and 3 comprises a framework 23 and a reinforcing structure 25 joined to the framework 23. The framework 23 has a web-facing surface 23*a*, a machine-facing surface 23*b*, and a plurality of deflection conduits 24 extending intermediate the web-facing surface 23*a* and the machine-facing surface 23*b*. In one preferred embodiment, the framework 23 comprises a continuous pattern, and the plurality of deflection conduits 24 comprises a plurality of discrete orifices, or holes, extending from the web-facing surface 23*a* to the machine-facing surface 23*b*. This embodiment is primarily disclosed in the commonly assigned and incorporated by reference herein U.S. Pat. Nos. 4,528,239 issued Jul. 9, 1985 to Trokhan; 4,529,480 issued Jul. 16, 1985 to Trokhan; 4,637,859 issued Jan. 20, 1987 to Trokhan; 5,098,522 issued Mar. 24, 1992 to Trokhan et al.; 5,275,700 issued Jan. 4, 1994 to Trokhan; 5,334,289 issued Aug. 2, 1994 to Trokhan; and 5,364,504 issued Nov. 15, 1985 to Smurkoski et al.

In another embodiment, the framework 23 comprises a patterned array of protuberances extending from the web-facing surface 23*a* to the machine-facing surface 23*b*, and the plurality of conduits 24 comprises an essentially continuous pattern surrounding the protuberances. In addition, the individual protuberances may also have the orifices, or holes, disposed therein and extending from the web-facing surface 23*a* to the machine-facing surface 23*b* of the framework 23. This embodiment of the papermaking belt is primarily disclosed in the commonly assigned and incorporated by reference herein U.S. Pat. No. 4,245,025 issued Sep. 14, 1993 to Trokhan et al. and U.S. Pat. No. 5,527,428 issued Jun. 18, 1996 to Trokhan et al.

The present invention may also be utilized with woven belts having no framework, such for example as the belt disclosed in European Patent Application having Publication Number: 0 677 612 A2, filed Dec. 04, 1995; and the belt according to the commonly assigned U.S. Pat. No. 4,239,065 issued Dec. 16, 1980 to Trokhan and incorporated by reference herein.

As FIGS. 2, 3, and 4 show, the web-facing surface 23*a* defines the web-contacting side 21 of the papermaking belt 20, and the machine-facing surface 23*b* defines the backside 22 of the papermaking belt 20. Therefore, it also could be said that the deflection conduits 24 extend intermediate the web-contacting side 21 of the belt 20 and the backside 22 of the belt 20. Preferably, the conduits 24 are arranged in a pre-selected pattern in the framework 23. More preferably, the pattern of the arrangement of the conduits 24 is non-random and repeating.

The deflection conduits, or simply "conduits," 24 channel water from the fibers which rest on the web-facing surface 23*a* of the framework 23 (or the web-contacting side 21 of the belt 20) to the machine-facing surface 23*b* of the framework 23 (or the backside 22 of the belt 20) and provide areas into which the fibers of the web 10 can be deflected and rearranged to form domes 11 in the web 10. As used herein, the term "dome" indicates an element of the web 10 formed by the fibers deflected into the individual deflection conduit 24. Of course, if the papermaking belt 20 having an essentially continuous pattern of the plurality of conduits 24 is to be used, the domes 11 will comprise an essentially continuous pattern as well. The domes 11 generally correspond in geometry, and during the papermaking process in position, to the deflection conduits 24. By conforming to the deflection conduits 24 during the papermaking process, the regions of the web 10 comprising the domes 11 are deflected in the Z-direction, thereby extending essentially perpendicular to the general plane of the web 10 and thus increasing a thickness, or caliper, of the web 10. As has been defined hereinabove, the Z-direction is orthogonal to the general plane of the web 10 and the belt 20, as illustrated in FIGS. 2 and 3. The domes 24 protrude outwardly from the essentially continuous network of the web 10.

The web-facing surface 23*a* of the framework 23 comprises a web-side network formed therein and defining web-side openings 24*a* of the conduits 24 of the papermaking belt 20. The machine-facing surface 23*b* of the framework 23 comprises a machine-side network formed therein and defining machine-side openings 24*b* of the conduits 24 of the papermaking belt 20.

The paper having domes may be made by through-air drying processes according to the commonly assigned U.S. Pat. Nos. 4,528,239; 4,529,480; 5,245,025; 5,364,504; and 5,275,700, cited above and incorporated herein by reference.

The commonly assigned U.S. Pat. No. 5,628,876 issued May 13, 1997 in the name of Ayers et al., discloses a semi-continuous pattern of the framework 23 which also can be utilized in the belt 20 for the purposes of the present invention. The foregoing patent is incorporated by reference herein.

The reinforcing structure 25 of the preferred belt 20 is joined to the framework 23 and is positioned between the web-facing surface 23a and the machine-facing surface 23b of the framework 23. The reinforcing structure 25 has a first side 25a and a second side 25b. The first side 25a of the reinforcing structure 25 corresponds and is substantially parallel to the web-facing surface 23a of the framework 23. The second side 25b corresponds and is substantially parallel to the machine-facing surface 23a of the framework 23. As used herein and shown in FIGS. 2 and 3, the portion of the framework 23 extending from the first side 25a of the reinforcing structure 25 is an "overburden OB." More particularly, the overburden OB is defined by the distance between the first side 25a of the reinforcing structure 25 and the web-facing surface 23a of the framework 23. Different embodiments of the papermaking belt 20 may require the overburden OB to be in the range between about 1 mil and about 250 mils.

The reinforcing structure 25 can take any number of different forms. It can comprise a woven element, a non-woven element, a screen, a band or a plate having a plurality of holes. Preferably, the reinforcing structure 25 of the belt 10 comprises a woven element, and more particularly, a foraminous woven element. The reinforcing structure 25 may comprise a single-layer structure. This type of the reinforcing structure 25 is schematically illustrated in FIGS. 2 and 3. The reinforcing structure 25 may comprise a multi-layered structure. In the latter case, each layer may comprise a plurality of machine direction yarns interwoven with a plurality of cross-machine direction yarns. U.S. Pat. No. 5,496,624, issued Mar. 5, 1996 to Stelljes et al. is incorporated by reference herein to show an example of a suitable reinforcing structure 25.

The reinforcing structure 25 strengthens the framework 23. The reinforcing structure 25 has a suitable projected open area in order to allow the dewatering machinery employed in the papermaking process of the present invention to adequately perform its function of removing water from the web 10 and to permit water removed from the web 10 to pass through the belt 20. Therefore, the reinforcing structure 25 should be highly permeable to fluids such as air and water. As used herein, by "highly permeable," it is meant that the reinforcing structure 25 has an air permeability not less than about 200 cubic feet per minute (cfm) per square foot of its surface at a pressure differential of 100 Pascals. The air permeability is measured using a Valmet permeability measuring device, Model Wigo Taifun Type 1000, available from Valmet Corp. of Pansio, Finland. One skilled in the art will readily understand that the air permeability of the reinforcing structure 25 influences the resulting air permeability of the belt 20. The process of the present invention allows one to utilize the reinforcing structure 25 having the air permeability of greater than 1000 cfm per square foot at a pressure differential of about 100 Pascals.

Various embodiments of the preferred belt 20 comprising the framework 23 and the reinforcing structure 25 are disclosed in U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,098,522 issued to Smurkoski et al. on Mar. 24, 1992; U.S. Pat. No. 5,245,025 issued to Trokhan et al. on Sep. 14, 1993; U.S. Pat. No. 5,275,700 issued to Trokhan on Jan. 4, 1994; U.S. Pat. No. 5,334,289 issued to Trokhan et al. on Aug. 2, 1994; U.S. Pat. No. 5,364,504 issued to Smurkoski on Nov. 15, 1994; and U.S. Pat. No. 5,527,428 issued Jun. 18, 1996 to Trokhan et al., all patents are commonly assigned and incorporated by reference herein.

While in the present invention a woven element is preferred for the reinforcing structure 25 of the papermaking belt 20, a papermaking belt 20 can be made using a felt as a reinforcing structure, as set forth in U.S. Pat. No. 5,556,509 issued Sep. 17, 1996 to Trokhan et al. and the patent applications: Ser. No. 08/391,372 filed Feb. 15, 1995 in the name of Trokhan et al. and entitled: "Method of Applying a Curable Resin to a Substrate for Use in Papermaking"; Ser. No. 08/461,832 filed Jun. 5, 1995 in the name of Trokhan et al. and entitled: "Web Patterning Apparatus Comprising a Felt Layer and a Photosensitive Resin Layer." These patent and applications are assigned to The Procter & Gamble Company and are incorporated herein by reference.

According to the present invention, after the web 10 is transformed from the forming wire 10 to the papermaking belt 20, the web 10 is overlaid with a flexible sheet of material 30, as shown in FIGS. 1–3. Preferably, the flexible sheet of material, or simply "sheet," 30 is elastically-resilient, or elastically-deformable. By the term "elastically-deformable" it is meant that the sheet 30 is capable of stretching under and proportionally to the pressure to approximate the geometry of the deflection conduits 24 and of recovering its shape after the application of pressure stops. One preferred sheet 30 is the EXXTRAFLEX® film type "EXX 7 A-1" (having thickness of about 1.5 mils) available from Exxon Chemical America's Film Division's plant, Lake Zurich, Ill., Exxon Corporation (New Jersey Corporation), Flemington, N.J. 08822.

The commonly assigned U.S. Pat. No. 5,518,801 issued May 21, 1996 to Chappell et al. and incorporated by reference herein, discloses a web material that exhibits an elastic-like behavior along at least one axis when subjected to an applied and subsequently released elongation. Alternatively, the sheet 30 is a deformable non-resilient sheet loosely maintained in a proximate relation to the belt 20 such that when the pressure is applied to the sheet 30, the sheet 30 is capable of approximating the geometry of the deflection conduits 24 of the belt 20. One skilled in the art will understand that the elastically-deformable sheet 30 loosely maintained in a proximate relation with the belt 20 may also be utilized and even be preferred when feasible.

FIG. 1 shows the sheet 30 as an endless belt supported by rolls 39a, 39b, 39c and traveling in a direction indicated by a directional arrow "C." While the sheet 30 in the form of the endless belt is preferred, the sheet 30 may be incorporated into numerous other forms, such as, for example, plates. One skilled in the art will also appreciate that when the endless sheet 30 is utilized in the process of the present invention, in order to maintain sufficient friction between the sheet 30 and the rolls 39a, 39b, 39c, it may be necessary to have the sheet 30 comprising essentially non-resilient endless loops, or trucks (not shown), having satisfactory tension characteristics.

As best shown in FIGS. 2 and 3, when the web 10 is overlaid (or "covered") by the sheet of material 30, the web 10 is disposed intermediate the sheet of material 30 and the papermaking belt 20. As shown in FIGS. 2 and 3, the sheet 30 has two sides, a first side 31 associated with the web 10, and a second side 32 opposite the first side 31. Therefore, when the web 10 is overlaid with the sheet 30, the web 10 is disposed between the first side 31 of the sheet 30 and the web-contacting side 21 (or the web-facing surface 23a of the framework 23) of the papermaking belt 20.

In accordance with the present invention, the sheet 30 has a sheet air permeability As less than the belt air permeability Ab of the papermaking belt 20. Preferably, the sheet 30 of the present invention is air-impermeable. By the term "air impermeable" it is meant that, for all practical purposes, air cannot pass through the sheet 30 without destroying physical integrity of the sheet 30.

After the web 10 has been overlaid with the sheet 30, a fluid pressure differential of a suitable fluid is applied to the sheet 30. Of course, one skilled in the art will readily understand that because the sheet 30 is at this point in close association with the web 10 disposed on the papermaking belt 20, the fluid pressure differential is also applied to the web 10 and the belt 20. As shown in FIG. 1, one method of applying the fluid pressure differential is by disposing the web 10 in association with the sheet 30 and the belt 20 in such a way that the sheet 30 is exposed to the vacuum pressure through the conduits 24 by the application of vacuum from the backside 22 of the belt 20. In FIG. 1, the directional arrows indicated by a symbol "P" schematically show the direction of the application of the vacuum pressure effectuated by the multislot vacuum box **26*b*. Preferably, a vacuum pressure of between approximately 15 and 25 inches (38.1 and 63.5 cm) of Mercury is applied at the multislot vacuum box 26*b***.

In the preferred embodiment of the present invention, the fluid pressure differential will typically be a positive pressure (i. e., greater than atmospheric pressure) in the form of air or steam pressure. The preferred fluid is air. Alternatively, or additionally, a negative pressure can be applied to the sheet 30 in the direction of the arrows "P" shown in FIG. 1. A means for applying the preferred positive pressure are conventional and are in the sphere of knowledge of one skilled in the art, and therefore are not shown in FIG. 1.

The application of the fluid pressure differential causes deflection of at least a portion of the sheet 30 towards the belt 20. Because the sheet 30 is associated with the web 10, the deflection of at least a portion of the sheet 30 towards the belt 20 causes deflection of at least a portion of the web 10 towards the belt 20. FIGS. 2 and 3 show in greater detail the effect of the application of the fluid pressure differential to the sheet 30 disposed on the preferred papermaking belt 20 comprising the reinforcing structure 25 and the resinous framework 23 having the deflection conduits 24.

In FIGS. 2 and 3, a pressure P2 associated with the second side 32 of the sheet 30 is greater than a pressure P1 associated with the first side 31 of the sheet 30. (In FIGS. 2 and 3 both the pressure P1 and the pressure P2 are schematically indicated by the directional arrows.) As has been indicated above, the sheet 30 is preferably air-impermeable. Therefore, in the preferred embodiment of the present invention, the sheet 30 can be viewed as a "barrier" dividing an area surrounding it into two zones: a zone of the relatively high pressure P2 associated with the second side 32 of the sheet 30, and a zone of the relatively low pressure P1 associated with the first side 31 of the sheet 30. The resulting pressure P=P2-P1 comprises the fluid pressure differential.

The fluid pressure differential causes the entire sheet 30 to generally press the web 10 into the belt 20. In other words, the web 10 is "sandwiched" between the papermaking belt 20 and the sheet 30, with the sheet 30 imprinting the web 10 into the belt 20 under the application of the fluid pressure differential P. In addition, at least a portion of the sheet 30 (primarily the regions corresponding to the conduits 24 of the belt 20 in the Z-direction) are deflected from the general plane of the sheet 30 towards the belt 20 in the Z-direction, as FIGS. 2, 3, and 4 show. Of course, the sheet 30 should possess a sufficient flexibility to be capable of being partially deflected in the Z-direction under the application of the fluid pressure differential. Without being limited by theory, the applicant believes that under the application of the fluid pressure differential, the sheet 30 imprints the web 10 into the belt 20, expels water from the web 10 through the conduits 24, causes formation of the domes 11 in the web 10, and densifies the web 10.

FIGS. 2, 3, and 4 show that some portion of the fibers in the web 10—and thus the web 10 itself—has been displaced into the conduit 24 below the web-facing surface **23*a* of the framework 23 (or web-contacting side 21 of the belt 20) to form the dome 11**. In through-air drying processes of the prior art, in which the fibers are deflected into the deflection conduits as a direct result of the air's movement caused by the action of the fluid pressure differential, the rearrangement of the individual fibers in the web and their significant displacement into the conduits may occur. During deflection, fibers are comparatively free to rearrange and migrate from the web's surface adjacent the belt's network into the deflection conduits under the direct action of the passing-through air, thereby creating a relative paucity of the web over the network surface and a relative superfluity of the web within the deflection conduits. Therefore, the papers produced by through-air drying processes of the prior art may have regions of a relatively low basis weight (i. e., the weight of the fibers in the areas projected onto the plane of the paper web of the network regions) and regions of a relatively high basis weight (i. e., the weight of the fibers in the areas projected onto the plane of the paper web of the dome regions). Further, the density (weight per unit volume) of the network region of the prior art paper produces by the through-air drying may be high relative to the density of the domes.

In the process of the present invention, when the fibers of the web 10 are deflected into the conduits, the web 10 is in direct contact with the sheet 30. The fibers in the web 10 are not subjected (or are subjected to a much lesser extent in the case of a not preferred air-permeable sheet 30) to the direct action of the passing-through air. In contrast with the prior through-air drying processes, deflection of the fibers into the conduits 24 occurs primarily under the deflection of the sheet 30. The deflected regions of the sheet 30, and not the air itself, imprint the portions of the web 10 corresponding to the conduits 24 into the conduits 24. Therefore, it is believed that, while some rearrangement of the fibers in the web 10 may still occur during the deflection, the migration of the fibers from the web-side network regions of the web-facing surface **23*a* towards the deflection conduits 24 is significantly lessened, if not completely eliminated, compared to the migration of the fibers from the network regions in the web of the through-air drying. As a result, a paper sheet 50 produced by the process of the present invention has a more uniform basis weight distribution throughout the general plane of the web 10** and a more uniform density distribution, relative to the papers produced by high air flow differential pressure assisted processes of the prior art.

Of course, it should be understood that if the non-preferred air-permeable sheet 30 is utilized, some movement of the air through the air-permeable sheet 30 may still take place. In this case, a more significant migration of the fibers from the network regions of the web-facing surface **23*a* into the conduits 24 may occur. Then, the paper sheet 50 will have a less uniform basis weight distribution throughout the general plane of the web 10 and a less uniform density distribution, compared to the paper web 10 produced by the process utilizing the preferred air-impermeable sheet 30. However, because the sheet 30 imprints the web 10 into the belt 20, it is believed that even if some rearrangement of the fibers takes place in the case the air-permeable sheet 30 is utilized, it is still significantly inhibited by the pressing force of the sheet 30 on the web 10**.

Either at the time when the fibers in the web 10 are deflected into the conduits 24 to form the domes 11, or after such a deflection occurs, water is removed from the web 10. As has been discussed in greater detail hereinabove, in the high air flow differential pressure assisted processes of the prior art, deflection of the fibers into the conduits, water removal from the web, and rearrangement of the fibers occur under the direct action of the air passing through the web under the application of fluid pressure differential. It leads sometimes to a number of undesirable consequences, such as separation of the individual fibers from the web 10, some of which may completely pass through the papermaking belt 20—a phenomenon known as "pinholing"—and consequently, clogging the vacuum dewatering machinery. In contrast with high air flow differential pressure assisted processes of the prior art, the deflection of the fibers into the conduits 24 and water removal from the web 10 occur, in accordance with the present invention, under the deflection of the flexible sheet 30, thus effectively eliminating the cause of the pinholing of the web 10 and clogging of the vacuum dewatering machinery.

FIG. 2 shows a "deflection E," and FIG. 3 shows a "maximal deflection E-max," of the sheet 30. As has been discussed above, while the entire sheet 30 presses the web 10 into the belt 20 under the action of the fluid pressure differential, primarily the regions of the sheet 30 which are associated with (or correspond in a Z-direction to) the deflection conduits 24 are "deflected" (or displaced in the Z-direction) most. As used herein, these regions are defined as "deflected" regions, or portions, of the sheet 30. The domes 11 of the web 10 generally correspond in geometry and in position to the deflected regions of the sheet 30. The rest of the sheet 30—a portion that does not deflect—is an "undeflected" portion, or region, of the sheet 30. Essentially each individual deflected region of the sheet 30 is encompassed by, and isolated one from another, by the essentially planar and undeflected portion of the sheet 30. Of course, when the described above belt 20 having the framework 23 comprised of the patterned array of protuberances and the plurality of conduits 24 comprised of the essentially continuous pattern is used, the deflected regions of the sheet 30 comprise an essentially continuous pattern extending in the Z-direction. As has been defined above, the Z-direction (indicated in FIGS. 2 and 3 by a symbol "Z") is perpendicular to the general plane of the web 10 and the belt 20, and therefore—to the general plane of the sheet 30, as illustrated in FIGS. 2 and 3.

The term "deflection" ("maximal deflection") of the sheet 30 indicates a distance "E" in FIG. 2 (distance "E-max" in FIG. 3) to which the part of the sheet 30 associated with the conduit 26 is displaced, or pulled, in the Z-direction under the action of the fluid pressure differential. In other words, the "deflection" is measured by the Z-directional distance between a point F furthest displaced in the Z-direction on the first side 31 of the deflected portion of the sheet 30 and the rest of the first side 31 of the generally undeflected, and otherwise generally planar, portion of the sheet 30.

As FIGS. 2 and 3 illustrate, the deflected portions of the sheet 30 may (FIG. 3) or may not (FIG. 2) deflect into the conduits 24. By "deflecting into the conduits 24" it is meant that the point F furthest displaced in the Z-direction on the first side 31 of the deflected part of the sheet 30 is located "below" the level of the web-facing surface 23*a* of the framework 23 (or the web-contacting side 21) of the belt 20, as shown in FIG. 3. In contrast, FIG. 2 shows that the point F furthest displaced in the Z-direction on the first side 31 of the deflected part of the sheet 30 is located "above" the level of the web-facing surface 23*a* of the framework 23 (or the web-contacting side 21) of the belt 20. The maximal deflection E-max indicates the deflection necessary for the sheet 30 to deflect into the conduits 24 in the Z-direction.

One skilled in the art will appreciate that the flexibility, thickness, and air-permeability of the sheet 30, a specific design of the belt 20, including but not limited to the relative size and geometry of the conduits 24, and the amount of pressure differential applied to the sheet 30 are interrelated characteristics of the process of the present invention.

While FIGS. 2 and 3 shows the embodiments of the papermaking belt 20 in which the web-side openings 24*a* are greater than the corresponding back-side openings 24*b* in at least one direction of the X-Y plane, FIG. 4 shows the embodiment of the papermaking belt 20 in which the web-side openings 24*a* are smaller than the corresponding back-side openings 24*b* in at least one direction of the X-Y plane. Such a design of the papermaking belt 20 having a substantially continuous framework 23 and a plurality of deflection conduits 24 allows to create "mushroom" domes 11 in the paper web. As used herein, the "mushroom" dome 11 is a dome 11 whose distal portion in a cross-section is larger than a portion adjacent to the surface of the web 10 associated with the web-facing surface 23*a* of the framework 23. It is believed that the web 10 having mushroom domes is softer relative to the webs produced under traditional through-air drying conditions, due to easier collapsibility of the mushroom domes 11, compared to the traditional domes 11. It is also believed that the mushroom domes 11 of the type shown in FIG. 4, in combination with corresponding similar mushroom domes of a counter part, may successfully be utilized as fastening means. In the latter case, the mushroom domes 11 should preferably be treated (thermally, with a binder, or otherwise) to become more rigid. Synthetic fibers, or filaments, may be used for the purposes of forming such a fastening means. The commonly assigned U.S. Pat. Nos. 5,058,247 issued Oct. 22, 1991 to Thomas et al.; 5,116,563 issued May 26, 1992 to Thomas et al.; 5,230,851 issued Jul. 27, 1993 to Thomas et al.; 5,540,673 issued Jul. 30, 1996 to Thomas et al.; 5,565,255 issued Oct. 15, 1996 to Young et al. are incorporated by reference herein.

One skilled in the art will readily understand that such properties of the sheet 30 as thickness and flexibility greatly influence the amount of the fluid pressure differential necessary to achieve a required deflection of the sheet 30 for a given papermaking belt 20. For a given sheet 30, papermaking belt geometry, and web caliper, the fluid pressure differential should be sufficient to achieve the desired maximal deflection E-max of the sheet 30.

In the case when the non-preferred air-permeable sheet 30 is utilized, the relative air-permeability of the sheet 30 and the belt 20, or the ratio Ab/As, is one of the characteristics defining the extent of the deflection of the sheet 30 towards the belt 20. When the air-permeable sheet 30 is utilized, the preferred ratio Ab/As is greater than about 2.0. The more preferred ratio Ab/As is greater than about 10.0. The most preferred ratio Ab/As is greater than about 20.0.

Referring now to FIG. 1, at some point in the process, the sheet 30 is removed from over the web 10. Preferably, the sheet 30 is not removed earlier than when the process of deflection of the fibers into the conduits 24 and water removal from the web 10 is essentially completed. The process of deflection of the fibers into the conduits 24 and water removal from the web 10 is considered essentially completed when a consistency of at least 25% of the web 10 is reached.

Optionally, the process of the present invention may include a step of pre-drying the web 10. Any convenient means conventionally known in the papermaking art can be used to pre-dry the web 10. For example, flow-through dryers, non-thermal capillary dewatering devices, and Yankee dryers, alone and in combination, may be satisfactory used to dry the web 10. FIG. 1 shows the optional pre-dryer 27. As has been noted above, the sheet 30 is preferably removed before the step of pre-drying starts, especially if a flow-through equipment is utilized for the step of pre-drying. The quantity of water removed in the pre-dryer 27 is controlled so that the web 10 exiting the pre-dryer 27 has a consistency of from about 30% to about 98%. Pre-dried web 10, which is still associated with the belt 20, passes around the return roll 29*c* and travels in the direction indicated by the directional arrow "B" to the impression roll 29*b*.

An optional step of impressing the web-side network of the web-facing surface 23*a* into the web 10 may be performed by interposing the web 10 between the belt 20 (with which the web 10 is still associated) and a rigid surface 40*a* of the Yankee dryer 40. As FIG. 1 illustrates, the web 10 in association with the belt 20 passes through the nip formed between the impression roll 29*b* and the Yankee dryer drum 40.

The next step of the process of the present invention is drying the web 10. If the optional step of imprinting the web 10 is performed, the web 10 separates from the papermaking belt 20 after the web-side network of the web-facing surface 23*a* has been impressed into the web 10. As the web 10 separates from the belt 20, the web 10 is adhered to the surface 40*a* of the Yankee dryer drum 40 where the web 10 is dried to a consistency of at least about 90%.

After the drying step, the optional step of foreshortening of the dried web 10 may be utilized in the process of the present invention. Foreshortening is a reduction in length of a dry paper web which occurs when energy is applied to the dry web in such a way that the length of the web is reduced and the fibers in the web are rearranged with an accompanying disruption of some fiber-fiber bonds. Foreshortening can be accomplished in any of several well-known ways. The most common, and preferred, method of foreshortening is creping.

In the creping operation, the dried web 10 is adhered to a surface and then removed from that surface with a doctor blade 45. As shown in FIG. 1, the surface to which the web 10 is usually adhered also functions as a drying surface. Typically, this surface is the surface 40*a* of a Yankee dryer drum 40 as shown in FIG. 1.

The adherence of the optionally imprinted web 10 to the surface of Yankee dryer drum 40 is facilitated by the use of a creping adhesive. Typical creping adhesives can include any suitable glue, such as those based on polyvinyl alcohol. Specific examples of suitable adhesives are described in U.S. Pat. No. 3,926,716 issued to Bates on Dec. 16, 1975, incorporated by reference herein. The adhesive is applied either to web 10 immediately prior to its passage through the above described nip, or more preferably to the surface of Yankee dryer drum 40 prior to the point at which the web is pressed against the surface of Yankee dryer drum 40 by the impression roll 29*b*. The particular means of glue application and the technique for applying the glue used in the practice of the present invention are conventional, and are, therefore, not shown in FIG. 1. Any technique for applying the creping adhesives known to those skilled in the art, such as spraying, can be used. Generally, only the undeflected portions of the web 10 which have been associated with web-side network of the web-facing surface 23*a* of the papermaking belt 10 are directly adhered to the surface of Yankee dryer drum 40. The paper web 10 produced by the process of the present invention, can be optionally calendered and is either rewound with or without differential speed rewinding or is cut and stacked all by conventional means which are not illustrated in FIG. 1. The paper web 10 is then ready for use.

To increase the soft tactile sensation of the paper web 50 produced by the process of the present invention, chemical softeners may be added to the web 10, as one skilled in the art will readily recognize. Suitable chemical softeners may be added according to the teachings of the commonly assigned U.S. Pat. Nos. 5,217,576 issued Jun. 8, 1993 to Phan; and 5,262,007 issued Nov. 16, 1993 to Phan et al., the disclosures of which patents are incorporated herein by reference. Additionally, silicone may be applied to the paper according to the present invention as taught by the commonly assigned U.S. Pat. Nos. 5,215,626 issued Jun. 1, 1993 to Ampulski et al.; and 5,389,204 issued Feb. 14, 1995 to Ampulski, the disclosures of which patents are incorporated herein by reference.

What is claimed is:

1. A process for making a paper sheet, which process comprises the steps of:

(a) providing an aqueous dispersion of papermaking fibers;

(b) forming a web of said papermaking fibers from said aqueous dispersion on a forming wire;

(c) transferring said web from said forming wire to a papermaking belt having a web-contacting side and a backside opposite said web-contacting side, said papermaking belt having a belt air permeability Ab;

(d) providing a flexible sheet of material having a first side and a second side opposite said first side, said sheet of material having a sheet air permeability As less than said belt air permeability Ab;

(e) overlaying said web with said sheet of material such that said web is disposed intermediate said first side of said sheet of material and said web-contacting side of said papermaking belt;

(f) applying a fluid pressure differential to said sheet of material such that a pressure P2 associated with said second side of said sheet of material is greater than a pressure P1 associated with said first side of said sheet of material, thereby causing deflection of at least a portion of said sheet of material towards said papermaking belt and removal of water from said web through said papermaking belt;

(g) removing said sheet of material from said web; and (h) drying said web to form said paper sheet.

2. The process according to claim 1, wherein said flexible sheet of material comprises an elastically-deformable sheet.

3. The process according to claim 1, wherein said flexible sheet of material comprises an essentially non-resilient deformable sheet.

4. The process according to claim 1, wherein said papermaking belt comprises:

a framework having a web-facing surface defining said web-contacting side of said papermaking belt, a machine-facing surface defining said backside of said papermaking belt, and a plurality of deflection conduits extending intermediate said web-facing surface and said machine-facing surface, said web-facing surface having a web-side network formed therein and defining web-side openings of said conduits, and said machine-facing surface having a machine-side network formed therein and defining machine-side openings of said conduits; and a reinforcing structure joined to said framework and positioned between said web-facing surface and said machine-facing surface of said framework, said reinforcing structure having a first side corresponding to said web-facing surface of said framework, and a second side corresponding to said machine-facing surface of said framework, said web-facing surface of said framework and said first side of said reinforcing structure defining an overburden therebetween.

5. The process according to claim 4, wherein said reinforcing structure of said papermaking belt has an air permeability of greater than about 1000 cubic feet per minute per square foot of its surface at a pressure differential of 100 Pascals.

6. The process according to claims 4 or 5, wherein said papermaking belt has an air permeability Ab greater than about 200 cubic feet per minute per square foot of its surface at a pressure differential of 100 Pascals.

7. The process according to claim 5, wherein said deflection of at least said portion of said sheet of material causes a deflection of at least a portion of said papermaking fibers in said web into said deflection conduits and removal of water from said web through said conduits.

8. The process according to claim 7, wherein said sheet of material has said sheet air permeability As of less than about 25 scfm at a pressure differential of 100 Pascals.

9. The process according to claim 8, wherein said sheet of material is air-impermeable.

10. The process according to claim 9, wherein portions of said sheet of material deflect into said deflection conduits of said papermaking belt to form a maximal deflection.

11. The process according to claim 10, wherein said maximal deflection of said sheet of material is greater than about 25% of said overburden of said papermaking belt.

12. The process according to claim 1 comprising an additional step of pre-drying said web in association with said papermaking belt to a consistency of from about 30% to about 95%.

13. The process according to claim 12, wherein said additional step of pre-drying said web is performed prior to the step (g).

14. The process according to claim 1, comprising an additional step of impressing said web-side network of said web-facing surface into said web by interposing said web between said papermaking belt and a rigid surface prior to the step (h).

15. The process according to claim 14, wherein said rigid surface comprises a Yankee drying drum.

16. The process according to claim 15, further comprising a step of foreshortening said web.

17. The process according to claim 16, wherein said step of foreshortening comprises creping.

18. The process according to claim 1, wherein said fluid pressure differential is a positive pressure.

19. The process according to claim 1, wherein said fluid pressure differential is a negative pressure.

20. A process for making a paper sheet, which process comprises the steps of:

(a) providing an aqueous dispersion of papermaking fibers;

(b) forming a web of said papermaking fibers from said aqueous dispersion on a forming wire;

(c) transferring said web from said forming wire to an air-permeable papermaking belt having a web-contacting side and a backside opposite said web-contacting side;

(d) providing a flexible air-impermeable sheet of material having a first side and a second side opposite said first side;

(e) overlaying said web with said sheet of material such that said web is disposed intermediate said first side of said sheet of material and said web-contacting side of said papermaking belt;

(f) applying a fluid pressure differential to said web associated with said papermaking belt and said sheet of material such that a pressure P2 outside said second side of said sheet of material is greater than a pressure P1 outside said first side of said sheet of material, thereby deflecting at least a portion of said sheet of material towards said papermaking belt and causing a deflection of at least a portion of said papermaking fibers towards said papermaking belt and removal of water from said web through said papermaking belt;

(g) removing said sheet of material from over said web;

(h) drying said web to form said paper sheet; and (i) foreshortening said paper sheet.

* * * * *